US009091021B2

(12) United States Patent
Heller

(10) Patent No.: US 9,091,021 B2
(45) Date of Patent: Jul. 28, 2015

(54) METHOD OF DYEING CELLULOSIC SUBSTRATES

(75) Inventor: Timothy Scott Heller, Lexington, SC (US)

(73) Assignee: Oasis Dyeing Systems, LLC, Batesburg-Leesville, SC (US)

( * ) Notice: Subject to any disclaimer, the term of this patent is extended or adjusted under 35 U.S.C. 154(b) by 0 days.

(21) Appl. No.: 13/269,720

(22) Filed: Oct. 10, 2011

(65) Prior Publication Data

US 2012/0088113 A1 Apr. 12, 2012

Related U.S. Application Data

(60) Provisional application No. 61/392,338, filed on Oct. 12, 2010, provisional application No. 61/439,431, filed on Feb. 4, 2011.

(51) Int. Cl.

| | |
|---|---|
| ***D06P 1/38*** | (2006.01) |
| ***D06P 3/62*** | (2006.01) |
| ***D06P 3/66*** | (2006.01) |
| ***D06P 5/22*** | (2006.01) |
| ***D06P 1/00*** | (2006.01) |
| ***D06P 5/00*** | (2006.01) |
| ***D06B 1/08*** | (2006.01) |
| ***D06P 1/22*** | (2006.01) |
| ***D06P 1/66*** | (2006.01) |
| ***D06P 3/60*** | (2006.01) |
| ***D06P 5/20*** | (2006.01) |

(52) U.S. Cl.

CPC ..... *D06P 1/0016* (2013.01); *D06B 1/08* (2013.01); *D06P 1/228* (2013.01); *D06P 1/66* (2013.01); *D06P 3/6025* (2013.01); *D06P 3/62* (2013.01); *D06P 3/66* (2013.01); *D06P 5/002* (2013.01); *D06P 5/2077* (2013.01); *D06P 5/22* (2013.01)

(58) Field of Classification Search

CPC ..... D06B 5/06; D06B 5/08; D06B 5/16; D06B 3/04; D06B 3/10; D06B 3/14; D06B 3/22; D06B 1/02; D06B 1/10; D06B 1/08; D06M 11/13; D06M 23/04; D06M 101/06; D06P 5/02; D06P 3/60; D06P 3/62; D06P 1/0016; D06P 1/228; D06P 1/66; D06P 3/0625; D06P 5/2077; D06P 3/6025; D06P 3/66; D06P 5/22; D06P 5/002; D06P 2001/0092

USPC ..... 8/115.51, 115.6, 116.1, 188, 477, 932, 8/930, 918, 181, 149.3, 495, 469, 636

See application file for complete search history.

(56) References Cited

U.S. PATENT DOCUMENTS

| | | | | | |
|---|---|---|---|---|---|
| 3,913,359 | A | * | 10/1975 | Childers et al. | 68/183 |
| 4,345,909 | A | * | 8/1982 | Guth et al. | 8/477 |
| 4,615,709 | A | * | 10/1986 | Nakao | 8/599 |
| 4,655,056 | A | | 4/1987 | Zeiffer | |
| 4,737,156 | A | * | 4/1988 | Tambor et al. | 8/490 |
| 6,395,088 | B1 | * | 5/2002 | Zeiffer | 118/410 |
| 6,508,882 | B1 | | 1/2003 | Zeiffer et al. | |
| 6,997,962 | B2 | | 2/2006 | Alpert | |
| 2009/0178205 | A1 | | 7/2009 | Klutz et al. | |

FOREIGN PATENT DOCUMENTS

WO WO-9951686 10/1999

OTHER PUBLICATIONS

Derwent abstract 1972-60735T , 1972.*

Hauser, P., *Advances and Trends in Textil Wet Processing Chemicals*, JTATM—North Carolina State University, College of Textiles (Feb. 2, 2006) 8 pages.

Kanik, M. et al., *Effect of Cationization on Inkjet Printing Properties of Cotton Fabrics*, AATCC Review, peerreviewed (Jun. 2004), pp. 22-25.

*Product Safety Assessment DOW™ Quat 188 Cationic Reagent*, The Dow Chemical Company (Jun. 18, 2009) 6 pages.

*Innovations, a Cleaner Way to Color Cotton*, Environmental Health Perspectives, vol. 110, No. 5 (May 2002), pp. A253-A254

*CR-2000 Chemical Reaction with Cotton*, Dow Answer Center [online] [retrieved Oct. 8, 2010]. Retrieved from the Internet: <URL: http://dow-answer.custhelp.com/app/answers/detail/a_id/9891/related/1/session/L2F2LzEv . . . >. (dated Sep. 22, 2009) 1 page.

*CR-2000 Cationic Reagent, Breakthrough Technology for Cationic Cotton*, The Dow Chemical Company (Mar. 2002) 4 pages.

*CFS® System*, Gaston Systems [online] [retrieved Oct. 8, 2010]. Retrieved from the Internet: <URL: http://www.gastonsystems.com/system/system.html>. (undated) 1 page.

*Invalon® DAM Liq Dispersing Agent, Dyeing Auxiliaries*, Technical Data Sheet, Hunstman (dated 2008) 5 pages.

Arioli: A steam specialist's best finishing touch | TechnoFront | Features | The ITJ [online] [retrieved Oct. 8, 2010]. Retrieved from the Internet: <URL: http://www.indiantextilejournal.com/articles/FAdetails.asp?id=1552>. (dated Oct. 2008) 4 pages.

International Search Report and Written Opinion for International Application No. PCT/US2011/055906.

* cited by examiner

*Primary Examiner* — Amina Khan

(74) *Attorney, Agent, or Firm* — Alston & Bird LLP

(57) ABSTRACT

The present invention is related to methods for dyeing a traveling cellulosic substrate. The methods include steps of cationizing a cellulosic substrate followed by applying foam including one or more dyes to the cationized cellulosic substrate.

21 Claims, 5 Drawing Sheets

| | DRY | WET | PERCHLOROETHYLENE |
|---|---|---|---|
| EXAMPLE 1 | 4.5 | 3.0 | 4.5 |
| COMPARATIVE EXAMPLE 2 | 4.5 | 2.0 | NOT TESTED |

FIG. 5

METHOD OF DYEING CELLULOSIC SUBSTRATES

CROSS-REFERENCE TO RELATED APPLICATIONS

This application claims the benefit of U.S. Provisional Application Nos. 61/392,338, filed on Oct. 12, 2010, and 61/439,431, filed Feb. 4, 2011, each of which is incorporated by reference in its entirety.

FIELD OF THE INVENTION

The present invention is generally related to methods of dyeing cellulosic substrates and yarns, such as cotton, rayon, linen, bamboo or a blend including cellulosic fibers.

BACKGROUND OF THE INVENTION

The most commonly used processes for imparting color to cellulosic materials are piece dyeing, continuous dyeing and yarn dyeing. In continuous dyeing, which is used primarily for fabrics that are to be a solid color, a continuous length of dry cloth is passed full-width through a trough of hot dye solution. The cloth then goes between padded rollers that squeeze in the color evenly and removes the excess liquid. In the piece dyeing method, the fabric, in a rope-like coil, is processed on a reel that passes in and out of a dye beck or vat. Yarn dyeing, which occurs before the cloth is woven or knitted, is used to produce gingham checks, plaids, woven stripes and other special effects. Blue dyed warp yarns, for example, are combined with white filling yarns in denim construction. One of the most commonly used yarn dyeing methods is package dyeing. In this system, yarn is wound on perforated cylinders or packages and placed on vertical spindles in a round dyeing machine. In each of these referenced dyeing methods, heat, chemicals, and salts must be added to the dye bath regardless of the chemical class of the dye being used. That is, a significant amount of energy, chemicals, and salt is required in transferring dye molecules from the dye solution to the fiber as well as in swelling the fiber to render it more receptive to dyeing. Even with the best processes, only a certain percentage of the dyes are transferred to the cellulosic fabric and the excess must be washed out in subsequent steps. These processes are problematic for dye application uniformity, they use large amounts of energy and create waste water that contains residual byes, chemicals, and salts.

Since the world currently uses cotton more than any other fiber, computers are used increasingly in dyeing processes to formulate and match colors with greater speed and accuracy as the demand for cotton appears to be growing. However, there remains a need for efficient and robust methods of dyeing cellulosic materials.

BRIEF SUMMARY OF THE INVENTION

The present invention provides methods for dyeing a continuously traveling cellulosic substrate, such as cotton or a blend including cotton. Methods according to embodiments of the present invention include a step of cationizing a cellulosic substrate followed by dyeing the substrate with a foam composition including at least one dye. In certain embodiments, the foam composition is generated with a foam generator to which air and liquid dyestuff is fed. The generated foam composition is transported through a conduit to an applicator head having a parabolic distribution chamber and a head slot that is disposed transversely with the continuously traveling substrate. With such a configuration, the foam composition can be continuously applied to the traveling substrate through the applicator head to provide a dyed cellulosic substrate. In certain embodiments, the freshly dyed cellulosic substrate (e.g., wet) is subjected to a steaming step in which the dyed cellulosic substrate is conveyed through a steamer unit such that the dyed cellulosic substrate is contacted with steam. Accordingly, the present invention also provides a dyed substrate prepared in accordance with methods of the present invention.

In one aspect, the present invention provides a system for dyeing a continuously traveling cellulosic substrate. In certain embodiments, the system includes at least one applicator head for dispensing dye a chemical composition (or compound alone) capable of dyeing a cellulosic substrate. Preferably, the applicator head(s) includes a parabolic distribution chamber and a head slot through with dye is dispensed onto a cellulosic substrate. In certain embodiments, the system can also include at least one foam generator, a steaming unit, or both.

BRIEF DESCRIPTION OF THE SEVERAL VIEWS OF THE DRAWINGS

Figure 1:
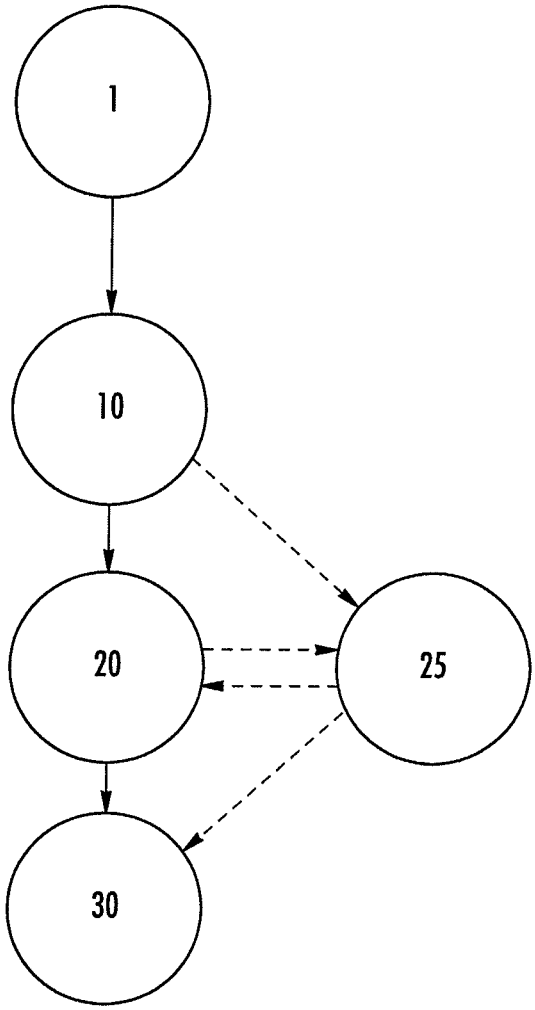
Figure 2:
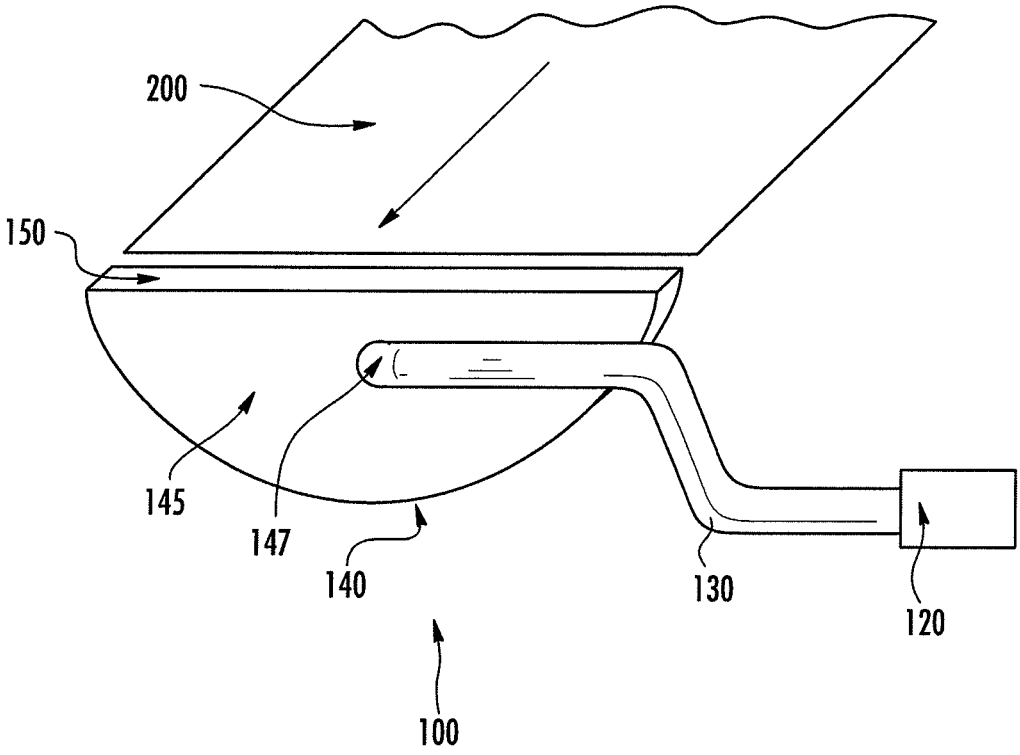
Figure 3:
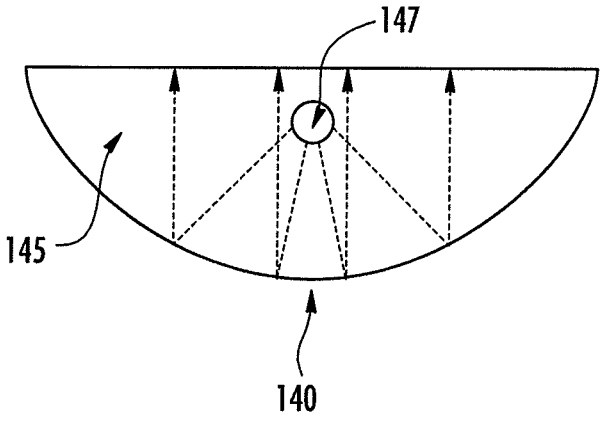
Figure 4:
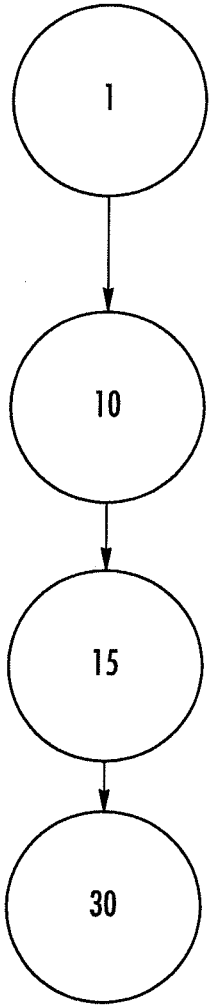
Figure 6:
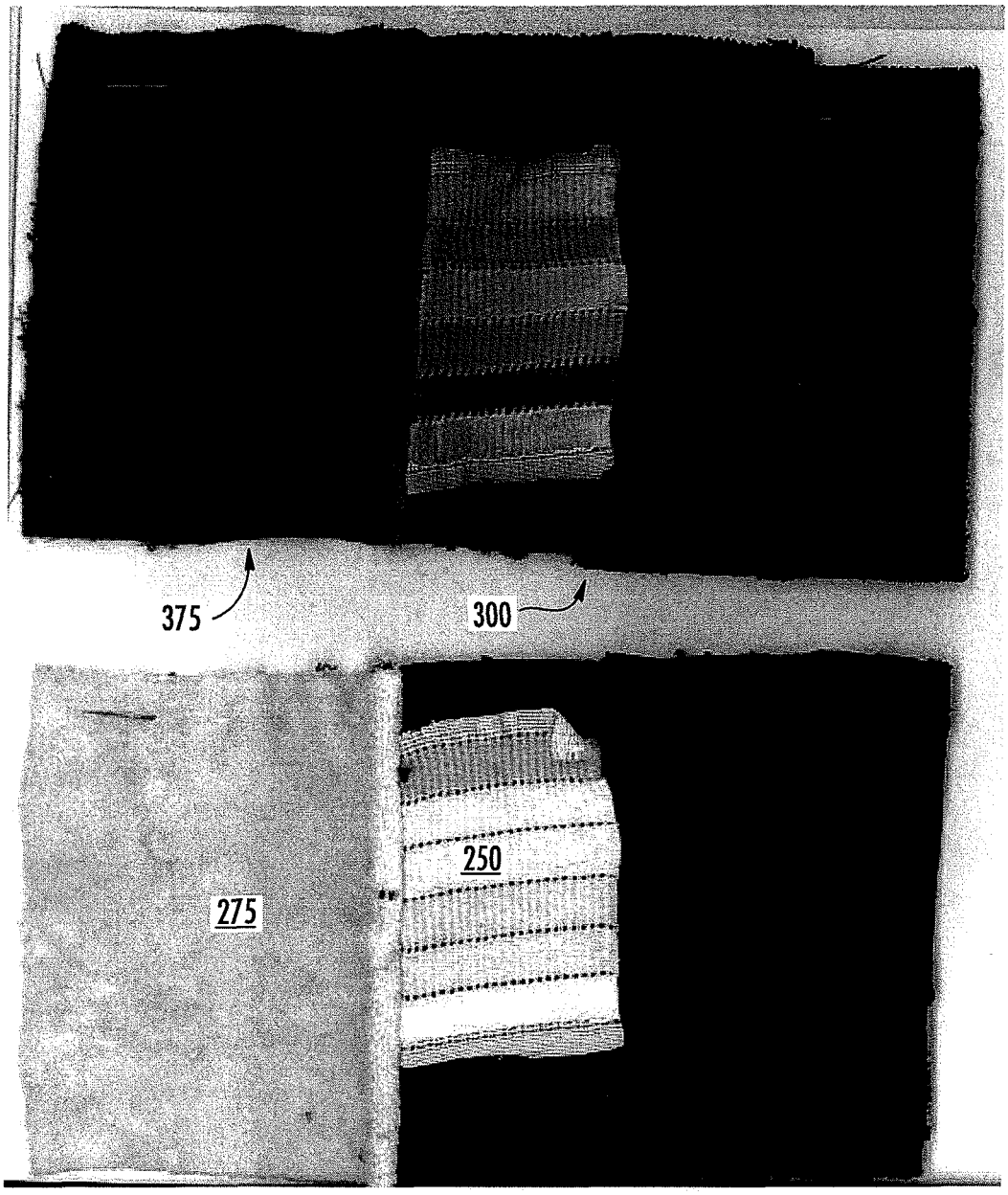

Having thus described the invention in general terms, reference will now be made to the accompanying drawings, which are not necessarily drawn to scale, and wherein:

FIG. 1 is a flow diagram illustrating processing steps according to one embodiment of the present invention;

FIG. 2 depicts a foam delivery apparatus including a foam generator, foam delivery conduit, and an applicator head used in certain embodiments of the present invention;

FIG. 3 is a parabolic distribution chamber illustrating the uniform foam flow through an applicator head;

FIG. 4 is a flow diagram illustrating processing steps according to certain embodiments of the present invention;

FIG. 5 shows the test results of crock testing (wet and dry) for a fabric dyed according to one embodiment of the present invention in comparison to crock testing results for a fabric produced according to a traditional method; and FIG. 6 shows the test results of an AATCC 2A wash test for a fabric dyed according to one embodiment of the present invention in comparison with test results for a fabric produced according to a traditional method.

DETAILED DESCRIPTION OF THE INVENTION

The present invention now will be described more fully hereinafter with reference to the accompanying drawings, in which some, but not all embodiments of the invention are shown. Indeed, the invention may be embodied in many different forms and should not be construed as limited to the embodiments set forth herein; rather, these embodiments are provided so that this disclosure will satisfy applicable legal requirements. As used in the specification, and in the appended claims, the singular forms "a", "an", "the", include plural referents unless the context clearly dictates otherwise.

As used herein, a "cellulosic" substrate or material can include a cotton fiber or a blend of cotton and synthetic fibers, in the form of a yarn, woven cloth, non-woven cloth, knitted cloth, or finished article. In certain embodiments, a "cellulosic" substrate or material as used herein, can also refer to a manufactured regenerated cellulose fiber or semi-synthetic material, such as rayon, linen, yarn and bamboo. As used herein, "yarn" refers to a continuous strand or strands of textile fibers or filaments in a form suitable for knitting, weaving, or other-wise interweaving to form a textile fabric.

As used herein, a "dye(s)" can include any commercially available chemical compound(s) or compositions(s) suitable for imparting color to cellulosic materials. For instance, one or more commercially available direct dyes can be used in certain embodiments while in other embodiments one or more fiber-reactive dyes can be used to impart color to cellulosic materials. If desired, a combination of direct dyes and fiber-reactive dyes can be used. In certain preferred embodiments, the dye exhibits an affinity for positively charged substrates or fibers, such as a cationized cellulosic substrate.

When dyeing cellulosic materials according to certain embodiments of the present invention, direct dyes and/or fiber reactive dyes are preferably used due to their anionic nature. Direct dyes create a relatively weak hydrogen bond with cellulose forming a semi-durable attachment. Traditionally, direct dyes have been applied directly from a water bath including a small amount of salt. Direct dyes are typically considered to be easier to use and less expensive, but they are not as washfast as fiber-reactive dyes. However, they exhibit good lightfastness and are ideal for use on textiles that are seldom washed. Fiber-reactive dyes are molecules that combine chromophores (the groups of atoms in a dye molecule that absorb light, which leads to color) with a reactive group that forms strong covalent bonds with the substrate being dyed. These strong covalent bonds provide good washfastness for the color. Traditional dyeing processes utilizing fiber-reactive dyes, however, require alkaline pH levels of the dye solution and significant amounts of electrolytes, or salts, such as sodium chloride or sodium sulfate (e.g., up to an amount equal to the weight of the substrate) to help screen the anionic dyes from the substrates charge.

In one aspect, the present invention provides a method of dyeing a traveling cellulosic substrate, such as cotton or a blend including cotton. According to embodiments of the present invention, the cellulosic substrate, prior to dyeing, undergoes a pretreatment step in which the cellulosic substrate is cationized. That is, the cellulosic substrate is treated such that it acquires a positive charge. As such, the positively charged cellulosic material will exhibit an increased affinity for negatively charged (or electron rich) molecules, such as many dyes (e.g., direct dyes and fiber-reactive dyes). After the substrate has been cationized, a foam composition including one or more dyes (e.g., direct dyes, fiber-reactive dyes, pigments, or combination thereof) is applied to one or more surfaces of the cellulosic substrate to provide a dyed cellulosic material. In certain preferred embodiments, a continuously traveling substrate is passed over and/or under a foam application location such that a continuous dyeing method is realized. According to certain embodiments, one or more strands of yarn (e.g., 1-5000) is pretreated such that the yarn stand(s) acquire a nearly permanent or permanent positive charge and therefore exhibit an increased affinity for negatively charged or electron rich molecules. The cationized yarn can be subjected to a dyeing process, such as a foam-based dyeing step, to provide dyed yarn.

As shown in FIG. 1, methods of dyeing a cellulosic substrate according to embodiments of the present invention generally include a cationizing step 1 in which the cellulosic substrate is rendered positively charged. The cationized cellulosic substrate is then transported, preferably continuously, through a dyeing step 10 in which a foam composition including one or more dyes is applied to the cationized cellulosic substrate to provide a dyed cellulosic substrate. One commercially available apparatus for dyeing the cationized cellulosic substrate is the CFS® SYSTEM provided by Gaston Systems Inc. (Stanley, N.C.). After application of the foam composition, the cellulosic substrate is preferably subjected to a steamer (e.g., a "steaming" step 20) where steam activates the bonding of the dye molecules with the modified cellulosic dye sites. That is, the substrate can be subjected to a steaming step 20 (e.g., the substrate can be directly exposed to saturated steam) upon exiting the dyeing step 10 such that the reaction between the cationized cellulosic substrate and the dye(s) is accelerated by subjecting the freshly dyed substrate to steam. The dwell time in the steamer can vary depending on the depth of shade desired, from 0.5 to 10 minutes (e.g., 1 to 5 minutes or 1 to 3 minutes). As customary, the dyed cellulosic substrate is subjected to a drying step 30 to remove any residual or entrained liquid (e.g., water) within the dyed cellulosic substrate. Beneficially, certain embodiments entirely remove any necessity for subjecting the dyed cellulosic substrate to a scouring step to remove unreacted dyes from the substrate. In other words, certain embodiments are devoid of traditional scouring steps. Traditional scouring steps require a substantial amount of hot water (near boiling) to clean the freshly dyed cellulosic substrate. As such, the elimination of such a scouring step reduces the amount of water consumed, the energy required to heat the water, and disposal costs for the contaminated water.

In certain preferred embodiments, the freshly dyed substrate is immediately subjected to the steaming step upon exiting the dyeing step. Although the particular steamer employed in the steaming step is not necessarily limited, industrial steamers such as the Vapo 2000, Vapo 2003, and Vapo 2008 commercially available from Arioli (ITALY) are suitable for certain embodiments of the present invention. In certain embodiments, the substrate is simply conveyed through a steamer that generates a cloud of steam. That is, the substrate is passed through a cloud of steam within the steamer unit. After being subjected to steam, the dyed cellulosic substrate is subjected to a drying step 30 to remove any residual or entrained liquid (e.g., water) within the dyed cellulosic substrate. Beneficially, certain embodiments entirely remove any necessity for subjecting the dyed cellulosic substrate to a scouring step to remove unreacted dyes from the substrate. That is, certain embodiments according to the present invention are devoid of a scouring step. As previously noted, scouring steps require a substantial amount of hot water to clean (e.g., wash out unreacted dyes) the freshly dyed cellulosic substrate. As such, the elimination of such a scouring step reduces the amount of water consumed, the energy required to heat the water, and disposal costs for the contaminated water.

In certain embodiments according to the present invention, the dyed substrate (e.g., substrate coated with wet dyes) is processed through a steamer unit such that the dyed substrate is contacted with steam from about 1 minute to about 30 minutes (e.g., residence time from 1-30 minutes), or from about 1 minute to about 20 minutes (e.g., residence time from 1-20 minutes), or from about 1 minute to about 10 minutes (e.g., residence time from 1-10 minutes), or from about 1 minute to about 5 minutes (e.g., residence time from 1-5 minutes). Beneficially, certain embodiments according to the present invention greatly reduce the residence time for which a cellulosic substrate is subjecting to a steaming process. For example, traditional steaming steps subject the dyed substrate to steam for 30 minutes or more. Furthermore, such traditional steaming steps require a subsequent water wash step to remove any unreacted dyes as discussed previously. Certain embodiments according to the present invention, however, entirely remove any necessity for subjecting the dyed cellulosic substrate to a water wash step traditionally required prior the present invention. If desired, however, a subsequent water wash step could optionally be included. As such, the mitigation of the amount of steam and elimination of such a wash water step reduces the amount of water consumed, the energy required to heat the water, and disposal costs for the contaminated water.

In certain embodiments, the residence time of the freshly dyed substrate in the steaming unit is determined at least in part by the desired shade from the dyeing step. For instance, darker shades can require a larger residence time in the steaming unit due to the increased number of dye molecules competing for the limited number of attachment sites on the cationized cellulosic substrate. Unlike darker shades, lighter shades have significantly fewer dye molecules competing for a surplus of attachment sites on the cellulosic substrate. As such, certain preferred embodiments according to the present invention provide methods of dyeing cellulosic substrates with dark shades while mitigating the amount of steam and elimination of a subsequent wash water step reduces the amount of water consumed, the energy required to heat the water, and disposal costs for the contaminated water.

As shown by dashed arrows in FIG. 1, certain embodiments can include an optional scouring step 25 in which the cellulosic substrate is washed with water, typically kept at or near the boiling point of water. It should be noted, however, that several embodiments of the present invention do not require a scouring step (i.e., devoid of a liquid water washing step). As such, scouring step 25 shown in FIG. 1 is not essential. If desired for some reason, the cellulosic substrate can be subjected to a scouring step 25 immediately after the dying step 10 or alternatively after a "wrap and roll" step 20. In certain embodiments, the amount of water used in the scouring step is no more than about 80%, 60%, 40%, 25%, 15%, 10%, or 5% of the amount of water required in a scouring step in a dyeing process not employing the combination of a cationizing step and a foam dyeing step according to embodiments of the present invention. Such embodiments, therefore, also beneficially reduce the amount of water consumed, the energy required to heat the water, and disposal costs for the contaminated water.

As shown in FIG. 1, the cellulosic substrate is subjected to a cationizing step prior to being dyed. In general, the cellulosic substrate is cationized by applying a quaternary ammonium chloride compound ("quat") which is capable of forming an ether linkage with hydroxyl groups of the cellulosic substrate. Thus, the positively charged portion of the quat is available for attracting and/or binding dye molecules. In certain embodiments, the cellulosic substrate is cationized by applying a liquid composition including 2,3-epoxypropyltrimethylammonium chloride to the cellulosic substrate to form a cationized substrate. Typically, the 2,3-epoxypropyltrimethylammonium chloride is formed by mixing 3-chloro-2-hydroxypropyltrimethylammonium chloride (i.e., CR-2000 available from Dow Chemical Co., USA) with a base, such as sodium hydroxide, to form an aqueous based liquid composition as shown in Reaction 1.

Reaction 1 - formation of 2,3-epoxypropyltrimethylammonium chloride

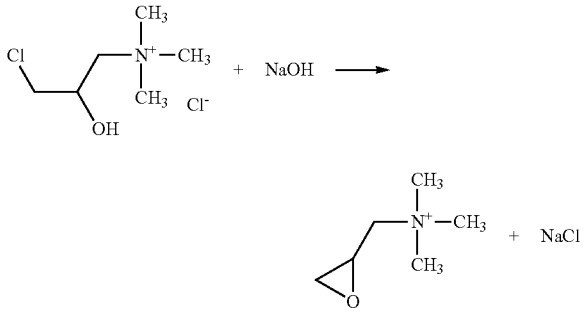

The 2,3-epoxypropyltrimethylammonium chloride readily reacts with cellulose to form cationic cellulose as shown in Reaction 2.

Reaction 2 - formation of cationic cellulose

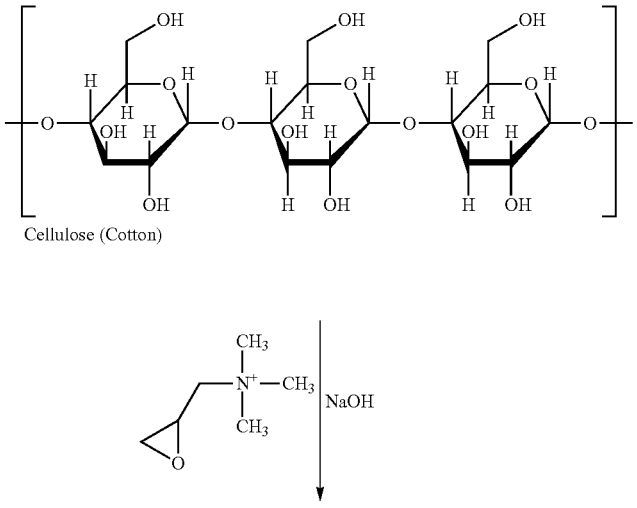

-continued

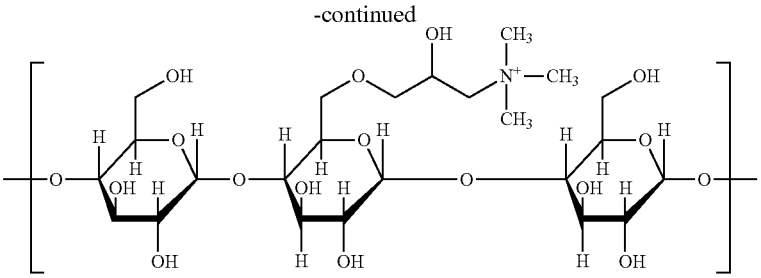

Cationic Cellulose (Cotton)

As shown in Reactions 1 and 2, CR-2000 (or the like) is mixed with an alkali to form a liquid composition of 2,3-epoxypropyltrimethylammonium chloride that can be applied to the cellulosic substrate in essentially any manner contemplated.

For example, the cellulosic substrate can be conveyed through a bath of the liquid composition so that the cellulosic substrate becomes saturated with the liquid composition. If desired, the cellulosic substrate can be passed through a pair of opposing rolls after exiting the liquid bath to further force the liquid composition into the interstices of the cellulosic substrate and to squeeze at least a portion of the liquid composition out of the substrate.

In certain embodiments, after the cationizing step the cellulosic substrate is collected on an uptake roll, optionally wrapped with a thin stretch wrap, and optionally rolled (e.g., rotated on the uptake roll) for about 1 hour to about 12 hours, for about 1 hour to about 8 hours, for about 1 to 4 hours, or for 1 to 2 hours. After being rotated on the uptake roll, the now cationized cellulosic substrate can optionally be washed to remove any 2,3-epoxypropyltrimethylammonium chloride that did not react with the cellulosic substrate. Although not particularly necessary, the cationized cellulosic substrate can be dried (e.g., by passing the substrate through an oven or by simply allowing liquid to evaporate from the substrate) to remove retained liquid from the substrate prior to dyeing.

After cationization of the cellulosic substrate, the positively charged cellulosic substrate is subjected to a foam dyeing process in which one or more surfaces (e.g., the top and bottom surfaces) of the cellulosic substrate is contacted with a foam composition including one or more dyes. The dyeing step, as shown in FIG. 2, can utilize a foam-based dyeing apparatus 100 including a foam generator 120 to which air, dyes (e.g., liquid dyestuff), and optionally water is fed for the generation of a foam composition including one or more dyes. The generated foam composition is transported through a conduit 130 to an applicator head 140, which may be in the form illustrated in U.S. Pat. No. 4,655,056 (the entire contents of which are hereby incorporated herein by reference), having a parabolic distribution chamber 145 in which the foam composition is distributed uniformly across the length of an applicator head slot 150 that is disposed transversely in contact with, preferably, a traveling cellulosic substrate 200 for application of the foam composition thereto in a uniform thickness. The foam composition can be delivered under pressure, with the delivery pressure and flow being controlled conventionally to provide a selected uniform thickness of coating application. In certain embodiments, the traveling substrate (preferably continually traveling) 200 is in pressure resisting contact with the applicator head slot 150 so that the pressurized foam composition will enter the interstices of the substrate in the case of a textile fabric or other similarly textured material.

Since the cellulosic substrate has been cationized, however, the dyes in the foam composition have an increased affinity for the cellulosic substrate and the dyeing step does not require saturation of the substrate with the foam composition to achieve uniform dyeing. That is, the cationized substrate facilitates the nearly complete exhaustion of the dyes. As such, nearly all of the dye in the foam composition is used. Consequently, less dye is needed in the dyeing step for a given segment of substrate and a reduced amount of unreacted dye remains in the substrate relative to traditional dye bath approaches and foam-based dyeing operations in which the substrate is saturated with a foam composition. For instance, in certain embodiments from about 50% to about 100% (e.g., from about 75% to about 99%, from about 95% to about 99%, or from about 95% to about 100%) of the dye in the foam composition is reacted and/or bound to the cellulosic substrate.

As shown in FIGS. 2-3, the conduit 130 is operatively connected to the distribution chamber 145 by an inlet port 147 through which the foam composition enters the distribution chamber. As shown in FIGS. 2-3, certain preferred embodiments utilize a distribution chamber 145 having a curved edge being generally parabolic in shape to define substantially all possible foam flow paths from the inlet port linearly to the curved edge linearly the respective shortest distances therefrom to the emission opening (i.e., head slot 150) to be of substantially the same total length. Accordingly, foam residence time within the distribution chamber is substantially constant regardless of the flow path assumed and uniform widthwise treatment of the traveling cellulosic substrate is realized.

In certain embodiments, the foam composition is applied to the cellulosic substrate via an applicator head having a parabolic distribution chamber and a head slot that is disposed transversely with a continuously traveling substrate such that foam composition is continuously applied to the traveling substrate through the applicator head. Although the geometry of the head slot is not necessarily limited, the head slot typically comprises a generally rectangular opening.

According to certain embodiments, the applicator head can be positioned either above or below the traveling cellulosic substrate. In certain embodiments, however, the a first applicator head is positioned underneath the traveling substrate such that foam composition is continuously applied to the bottom surface of the substrate and a second applicator head is positioned above the traveling substrate such that foam composition is also continuously applied to the top surface of the substrate. The relative location of the two applicator heads can vary. For instance, the two applicator heads can be positioned directly across from one another such that the bottom and top sides of the traveling substrate are continuously dyed simultaneously. Alternatively, the first applicator head (i.e., positioned underneath the travelling substrate) can be located "upstream" of the second applicator head (i.e., positioned on top of the travelling substrate) such that the bottom surface of the travelling substrate is contacted with dye prior to the top surface. Similarly, the applicator head dispensing dye onto the top surface of the travelling substrate can be positioned "upstream" of the applicator head dispensing dye onto the bottom surface of the travelling substrate if desired.

The coupled exploitation of the combination of a cationizing step and a non-saturating foam dyeing step according to embodiments of the present invention beneficially reduce the costs associated with dyeing cellulosic substrates. That is, the nearly complete exhaustion of the dyes during the foam-based dyeing step eliminate or at least substantially mitigate the need for scouring steps resulting in the reduced water usage, energy to heat the water, and reduced waste (i.e., water containing the unreacted/unbound dyes washed from the substrate after dye application). Additionally, the increased affinity of the dyes for the cationized substrate results in a noticeable reduction in the amount of dyes required for the dyeing of a unit of cellulosic material. Furthermore, the coupled exploitation of the cationization step in conjunction with the foam-based dyeing application also eliminates the need for adding substantial quantities of electrolytes (e.g., salts such as sodium chloride and sodium sulfate) to dye baths, which is yet an additional cost saving measure (i.e., cost to purchase and cost for disposal).

In another aspect, methods of dyeing a cellulosic substrate according to certain embodiments of the present invention include a "wrap and roll" step either immediately after the dyeing step or immediately after a steaming step. As shown in FIG. 4, methods of dyeing a cellulosic substrate according to certain embodiments of the present invention can include a cationizing step 1 in which the cellulosic substrate is rendered positively charged. The cationized cellulosic substrate is then transported, preferably continuously, through a dyeing step 10 in which a foam composition including one or more dyes is applied to the cationized cellulosic substrate to provide a dyed cellulosic substrate. One commercially available apparatus for dyeing the cationized cellulosic substrate is the CFS® SYSTEM provided by Gaston Systems Inc. (Stanley, N.C.). After application of the foam composition, the cellulosic substrate can undergo a "wrap and roll" step 15 in which the dyed substrate is collected on an uptake or collection roll. After collection of the entire length of the cellulosic substrate on the uptake roll, the collected substrate (now dyed) can be rotated from about 1 to about 10 hours, or about 1 to about 6 hours, or about 1 to 3 hours. As customary, the dyed cellulosic substrate is subjected to a drying step 30 to remove any residual or entrained liquid (e.g., water) within the dyed cellulosic substrate. Beneficially, certain embodiments entirely remove any necessity for subjecting the dyed cellulosic substrate to a scouring step to remove unreacted dyes from the substrate. That is, certain embodiments according to the present invention are devoid of a scouring step in which unreacted dyes are washed from the dyed substrate. Traditional scouring steps require a substantial amount of hot water (near boiling) to clean the freshly dyed cellulosic substrate. As such, the elimination of such a scouring step reduces the amount of water consumed, the energy required to heat the water, and disposal costs for the contaminated water.

Although FIG. 4 does not show a steaming step, certain embodiments can include both a steaming step and a "wrap and roll" step if desired. For instance, the "wrap and roll" step can occur either immediately after dyeing or immediately after the substrate is subjected to a steaming step. In additional embodiments, an optional scouring step can be included as well in which the cellulosic substrate is washed with water, typically kept at or near the boiling point of water. It should be noted, however, that several embodiments of the present invention do not require a scouring step. As such, a scouring step is not essential. If desired for some reason, the cellulosic substrate can be subjected to a scouring step and the amount of water used in the scouring step is no more than about 80%, 60%, 40%, 25%, 15%, 10%, or 5% of the amount of water required in a scouring step in a dyeing process not employing the combination of a cationizing step and a foam dyeing step according to embodiments of the present invention. Such embodiments, therefore, also beneficially reduce the amount of water consumed, the energy required to heat the water, and disposal costs for the contaminated water.

In one aspect, the present invention provides a system for dyeing a continuously traveling cellulosic substrate. In certain embodiments, the system includes at least one applicator head for dispensing dye a chemical composition (or compound alone) capable of cationizing a cellulosic substrate. Preferably, the applicator head(s) includes a parabolic distribution chamber and a head slot through with dye is dispensed onto a cellulosic substrate. In certain embodiments, the system can also include at least one foam generator, a steaming unit, or both.

WORKING EXAMPLES

The following examples are included for illustrative purposes only and are not intended to limit the scope of the present invention.

Example 1

A continuous 300 yard long cotton fabric was chemically pre-treated with 3-epoxypropyltrimethylammonium chloride at a rate of 20 yards per minute ("ypm"). Accordingly, the entire 300 yards of fabric had been treated in approximately 15 minutes at a power consumption of 3 KW/hr (0.75 KW total). The entire 300 yards of the treated fabric was wrapped on an uptake roll and rolled for 12 hours at 1.25 KW/hr (15 KW total). Subsequently, the entire 300 yards of fabric was washed at a rate of 10 ypm for 30 minutes to remove any unbound 3-epoxypropyltrimethylammonium chloride. The washing step utilized 1000 lbs of steam/hour (500 lbs of steam total) and 10 gallons/minute of a water wash (300 gallons of water used).

The treated fabric was then continuously dyed by the application of a foam composition (including an indigo dye) thereto via two applicator heads from Gaston Systems Inc. (Stanley, N.C.). A first applicator head was positioned underneath the bottom surface of the continuously travelling fabric and dyed the bottom surface of the fabric. The second applicator head was positioned downstream from the first applicator head and was mounted above the top surface for the fabric. The second applicator head dispensed the foam composition onto the top surface of the continuously travelling fabric. Accordingly, the continuously travelling fabric was first dyed on the underneath by the first applicator head and then on top by the second applicator head to provide a fabric freshly dyed on both top and bottom sides.

After exiting the dyeing unit operation, the fabric was passed through a steaming unit in which the freshly dyed fabric was passed through a cloud of steam. The dwell or residence time for section of the fabric was 1 minute. The total poundage of steam used in the steaming step was merely 330 lbs. After being subjected to the steaming operation, the fabric is rolled up and ready for a traditional drying operation to remove any undesired water content. A summary of utility costs/usage and dyeing materials is provided in Table 1 below.

Comparative Example 1

A traditional dyeing method involving loading 6 pieces of 50 yard long sections of cloth in a dye machine in rope form and sewing the ends together to provide a contiguous 300 yard fabric was carried out. The machine was filled with water, chemicals and dyes (indigo). The bath was then heated at 3 degrees/min to 190° F. Salt was then added in 3 separate steps over 3 hours. The lot was then cooled to 160° F. and sampled. In such a dying method, if the shade is not right, a dye adjustment is made and the bath is brought back to 190° F., held for 15 minutes and then cooled back to 160° F. again. Once the shade is correct, the bath is dropped and refilled one or two times depending on the depth of shade to wash off unreacted dyes. After the rinsing, the bath is dropped; the fabric is unloaded and opened up. It then goes through a wet brush to remove the wrinkles and creases that were formed in the dye machine. A summary of utility costs/usage and dyeing materials is provided in Table 1 below.

TABLE 1

Comparison of Utility Usage and Raw Materials for Each Dyeing Operation.

| | Comparative Example 1 | Example 1 |
|---|---|---|
| Grams of dye used | 5892 | 4451 |
| Gallons of salt solution used | 179 | 0 |
| Pounds of Steam Used | 8293 | 330 |
| Electricity (KW) | 26.8 | 1.86 |
| Water (Gallons) | 3515 | 43 |
| Labor Hours | 4.6 | 0.75 |

As shown in Table 1 above, the embodiment exemplified in Example 1 provided at least the following benefits: (1) roughly a 25% reduction in the amount of dyes that were used; (2) elimination of the salt solution; (3) roughly a 96% reduction in the amount of steam used; (4) roughly a 90% reduction in electricity usage; (5) roughly a 99% reduction in water (liquid) usage; and (6) roughly an 84% reduction in labor costs in terms of an hourly wage.

The dyed fabrics from Example 1 and Comparative Example 1 were dried and subjected to wet and dry crock testing as well as an AATCC 2A wash. The crock tests were performed according to AATCC Test Method 8-2007 Colorfastness to Crocking: AATCC Crockmeter Method. The 2A wash tests were performed according to AATCC Test Method 61-2010 Colorfastness to Laundering: Accelerated. The results of both wet and dry crock testing are rated on a scale from 1 to 5, with a score of "1" representing an undesirably extreme transfer of dye from the fabric being tested onto the white cotton test cloth and a score of "5" being most desirable as representing nearly zero transfer of dye from the dyed fabric.

As shown in FIG. 5, the dyed fabric from Example 1 realized a dry crock testing score of "4.5" and a wet crock testing score of "3.0". By contrast, the dyed fabric from Comparative Example 1 provided a wet crock of "2.0" (as evident by the dark circle of dye transferred from the dyed fabric) and a dry crock of "4.5". Accordingly, the fabric produced according to certain embodiments of the present invention beneficially provides better wet crock results.

FIG. 6 provides the test results of an AATCC 2A wash test for the fabric dyed of Example 1 200 in comparison with test results for the fabric produced according to a traditional method 300 in comparative Example 1. As shown in FIG. 6, fabric 200 made according to one embodiment of the present invention did not appear to transfer any dye (or at least not any appreciable amount of dye) to the multi-fiber strip 250 or to the uniform cotton strip 275 as is evident by the retained "whiteness" of the multi-fiber strip 250 and the uniform cotton strip 275. To the contrary, the dyed fabric according to Comparative Example 1 300 transferred a substantial quantity of dye to the multi-fiber strip 350 and the uniform cotton strip 375. For instance, the uniform cotton strip 375 was originally white. After the wash, however, the uniform cotton strip 375 had collected enough dye such that the uniform cotton stripe had an essentially navy blue shade. Accordingly, fabrics dyed according to certain embodiments of the present invention provide significantly improved wash fastness relative to fabrics dyed according to the traditional methods.

Many modifications and other embodiments of the invention set forth herein will come to mind to one skilled in the art to which this invention pertains having the benefit of the teachings presented in the foregoing description. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A method for dyeing a continuously traveling cellulosic substrate, consisting of:

(a) cationizing a cellulosic substrate, wherein the cellulosic substrate comprises cotton, rayon, linen, or combinations thereof and includes a top surface and a bottom surface and wherein the cellulosic substrate is cationized by applying a liquid composition comprising 2,3-epoxypropyltrimethylammonium chloride;

(b) collecting the cellulosic substrate by a wrapping-and-rolling step performed by wrapping the substrate onto an uptake roll and rotating the substrate on the uptake roll from about 1 to 12 hours;

(c) applying a foam composition comprising a dye amount of one or more dyes comprised of fiber-reactive dyes, direct dyes, or combinations thereof, wherein the foam composition is applied in the absence of added sodium chloride or sodium sulfate salts via at least one applicator head in which each applicator head has a parabolic distribution chamber and a head slot that is disposed transversely with the continuously traveling substrate such that the foam composition is continuously applied to the traveling substrate through the applicator head, to provide a dyed substrate having between about 95 to 100% of the dye amount from the foam composition bound to the cellulosic substrate; and (d) optionally:

(i) generating the foam composition including one or more dyes, (ii) washing the cellulosic substrate, (iii) steaming the cellulosic substrate, (iv) removing liquid from the cellulosic substrate, (v) collecting the dyed substrate, (vi) steaming the dyed substrate, (vii) washing the dyed substrate, (viii) removing liquid from the dyed substrate, or combinations thereof.

2. The method of claim 1, wherein the foam composition is generated prior to applying the foam composition to at least one surface of the substrate.

3. The method of claim 1, wherein the head slot comprises a generally rectangular opening.

4. The method of claim 1, wherein a first applicator head is positioned underneath the traveling substrate such that the foam composition is continuously applied to the bottom surface of the substrate.

5. The method of claim 4, wherein a second applicator head is positioned above the traveling substrate such that the foam composition is continuously applied to the top surface of the substrate.

6. The method of claim 4, wherein the first applicator head is located upstream from the second applicator head.

7. The method of claim 4, wherein the first applicator head is located downstream from the second applicator head.

8. The method of claim 4, wherein the first and second applicator heads are positioned directly opposite one another.

9. The method of claim 1, wherein 2,3-epoxypropyltrimethylammonium chloride is formed by mixing 3-chloro-2-hydroxypropyltrimethylammonium chloride with a base.

10. The method of claim 1, wherein cationizing the cellulosic substrate is performed by saturating the cellulosic substrate with the liquid composition including 2,3-epoxypropyltrimethylammonium chloride.

11. The method of claim 1, wherein removing liquid from the cellulosic substrate is performed by squeezing at least a portion of the liquid composition out of the substrate.

12. The method of claim 1, wherein removing liquid from the cellulosic substrate is performed by drying liquid from the substrate prior to dyeing.

13. The method of claim 1, wherein the cellulosic substrate is provided in the form of a yarn.

14. The method of claim 1, wherein the dyed substrate is subjected to a steaming step after the application of the foam composition.

15. The method of claim 14, wherein the dyed substrate is subjected to a steaming step from about 1 minute to about 5 minutes.

16. The method of claim 1, wherein steaming the dyed substrate is performed by subjecting the substrate to about 1.3 pounds of steam per yard of a 16 ounce/linear yard fabric or less.

17. The method of claim 1, wherein the cellulosic substrate is washed after the wrapping-and-rolling step and prior to step (c).

18. The method of claim 17, wherein removing liquid from the cellulosic substrate is performed by drying after the washing step and prior to step (c).

19. The method of claim 1, wherein washing the dyed substrate is performed by washing the dyed substrate in a reduced manner to limit electricity usage and water usage.

20. A method for dyeing a continuously traveling cellulosic substrate, consisting of:

(a) a pre-treatment step performed by cationizing a cellulosic substrate with a liquid composition, wherein the cellulosic substrate comprises cotton, rayon, linen, or combinations thereof and includes a top surface and a bottom surface;

(b) generating a foam composition including one or more dyes;

(c) collecting the cellulosic substrate by a wrapping-and-rolling step, the wrapping and rolling step performed by wrapping the substrate onto an uptake roll and rotating the substrate on the uptake roll from about 1 to 12 hours;

(d) a dyeing step performed by applying the foam composition to at least one surface of the continuously traveling substrate, the foam composition being applied to the at least one surface of the continuously traveling substrate via at least one applicator head comprising a parabolic distribution chamber and a head slot that is disposed transversely with the continuously traveling substrate such that the foam composition is continuously applied to the traveling substrate through the applicator head to provide a dyed substrate having between about 95 to 100% of the dye amount from the foam composition bound to the cellulosic substrate; and (d) optionally:

(i) washing the cellulosic substrate, (ii) steaming the cellulosic substrate, (iii) removing liquid from the cellulosic substrate, (iv) collecting the dyed substrate, (v) steaming the dyed substrate, (vi) washing the dyed substrate, (vii) removing liquid from the dyed substrate, or combinations thereof.

21. The method of claim 20, wherein washing the dyed substrate is performed by washing the dyed substrate in a reduced manner to limit electricity usage and water usage.

* * * * *